United States Patent [19]

Halloran

[11] Patent Number: 4,679,691

[45] Date of Patent: Jul. 14, 1987

[54] THREE-SIDED TIP TRAY

[76] Inventor: Kevin J. Halloran, 25200 Carlos Bee Blvd., Button Bash Plaza, SE. 380, Hayward, Calif. 94542

[21] Appl. No.: 764,728

[22] Filed: Aug. 12, 1985

[51] Int. Cl.[4] ..... B65D 1/34

[52] U.S. Cl. ..... 206/557; 206/0.8; 40/323; 40/324

[58] Field of Search ..... 206/557, 561, 0.8; D7/37, 45; 40/323, 324

[56] References Cited

U.S. PATENT DOCUMENTS

| | | | |
|---|---|---|---|
| D. 249,108 | 8/1978 | Cannon, Jr. | D7/37 |
| 622,999 | 4/1899 | Eichholz | 40/323 |
| 872,768 | 12/1907 | Smith | 40/323 |
| 1,613,756 | 1/1927 | Leaf | 40/324 |
| 2,467,530 | 5/1949 | Thompson | 206/557 |
| 2,781,650 | 2/1957 | Lee | 40/324 |
| 3,029,969 | 4/1962 | Buchel | 206/557 |
| 3,236,385 | 2/1966 | Becker | D7/37 |
| 3,514,887 | 6/1970 | Jacob | 40/324 |
| 3,517,825 | 6/1970 | Propst | D7/37 |
| 4,170,303 | 10/1979 | Nolan | 206/557 |

FOREIGN PATENT DOCUMENTS

| | | | |
|---|---|---|---|
| 466354 | 3/1914 | France | 40/323 |
| 1053103 | 2/1954 | France | 206/557 |
| 799651 | 8/1958 | United Kingdom | 40/324 |
| 1103185 | 2/1968 | United Kingdom | 206/562 |

*Primary Examiner*—William Price
*Assistant Examiner*—Brenda J. Ehrhardt

[57] ABSTRACT

A tip tray for use in restaurants or the like which is transparent and has a pair of slide tracks or slots formed by longitudinal leg bars on the bottom. The tracks accomodate cards upon which may be printed various written messages, photos, and/or other visuals which may be viewed through the transparent tray surface.

5 Claims, 6 Drawing Figures

THREE-SIDED TIP TRAY

BRIEF SUMMARY OF THE INVENTION

This invention relates to tip trays used in restaurants to deliver a customer's bill, secure the customer's payment, return change, and secure gratuities (i.e., tips). The basic purpose for using tip trays is to provide a pleasant medium through which the aforementioned activities can be performed.

The existing tip trays used by restaurants are of standard tip tray design. Hard, non-transparent plastic or a similar material is used in the tray's construction. The standard shape is rectangular and the standard colors are black or dark brown. These conventional tip trays perform the function listed above but lack any cosmetic appeal such as that provided by the present invention.

OBJECTS AND ADVANTAGES OF THE INVENTION

Although the existing tip tray performs the intended activities satisfactorily, the improved tip tray described herein also accomplishes the intended activities but, additionally, allows for expanded application.

The principal object of the invention is that its transparency provides for the presentation of a visual/print medium, the inclusion of advertisements or promotional material, or personal statements such as; special occasion greetings, seasonal greetings, limericks, famous quotes, ethnic themes, etc. This visual medium is displayed on cards which are removably retained in holding tracks beneath the transparent tray.

Another object of the invention is that a larger placement area is provided for the placement of the bill, currency, or credit card.

Still another object of the invention is that it presents an enhanced cosmetic appeal.

These and other objects and advantages of the invention will become apparent from a consideration of the drawings and the ensuing description thereof.

BRIEF DESCRIPTION OF THE DRAWINGS

In the drawings which disclose the preferred embodiment of the invention.

DETAILED DESCRIPTION OF THE PREFERRED EMBODIMENT

Figure 1:
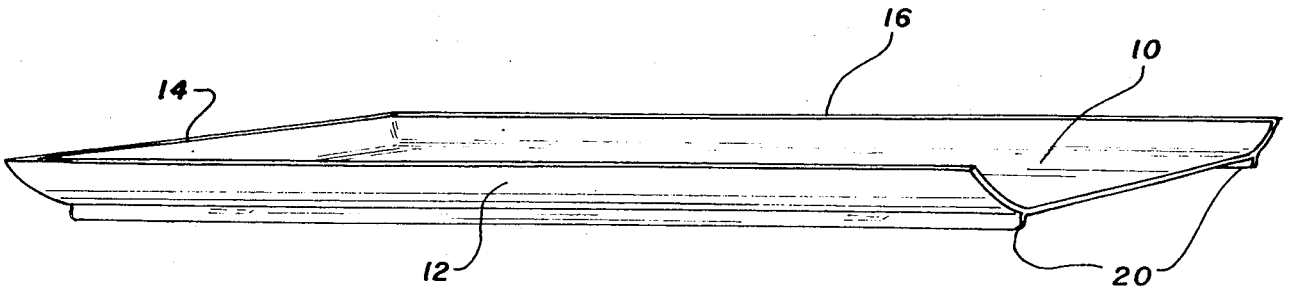
FIG. 1 is a top perspective view of the tip tray.

In the perspective view of FIG. 1, the tray includes a rectangular, planar, transparent plate 10 having short, upwardly slanted walls 12, 14, 16 along three sides. There is no wall at the front end of the tray surface, thereby enabling the easy removal of the bill, currency, or credit card. Thus the top surface of the plate 10, surrounded on three sides by the walls 12, 14, and 16, may be referred to as the placement area of the tray.

Figure 2:
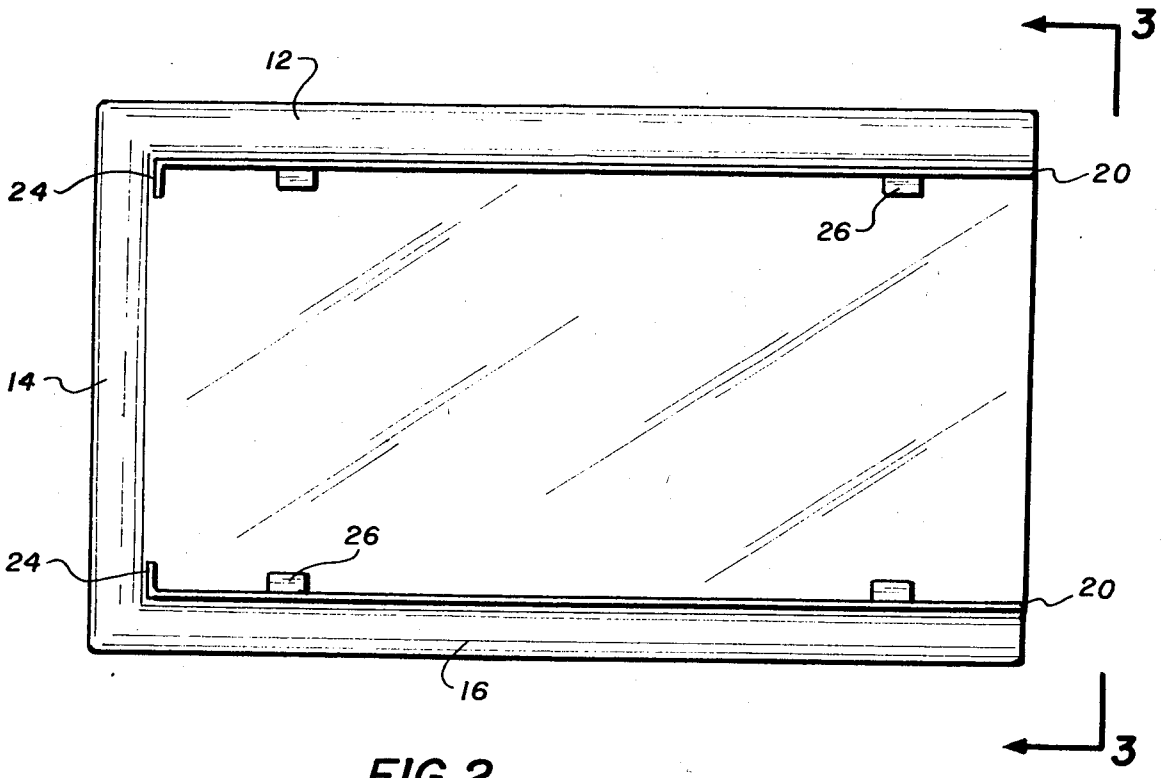
FIG. 2 is a bottom view of the tip tray.

As best illustrated in the bottom plan view of FIG. 2, the transparent plate is supported on a pair of narrow, elongated, substantially parallel support bars 20 existing along the longitudinal bottom edges of the plate 10. The bars extend a short distance aroung the rear end of the plate to form a stop member 24. Extruding from the support bars are support tabs 26. These tabs extend laterally inward and aid in securing any visual/print medium when inserted.

Figure 3:
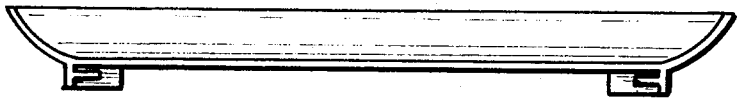
FIG. 3 is a front end view taken along the lines 3—3 of FIG. 2.

FIG. 3 is a front end view taken along the lines 3—3 of FIG. 2. This view highlights the relationship between the bottom surface of the plate 10 and the support tabs 26. The space clearance between both the plate and tabs are such that a card of standard card stock would insert neatly between the two. The stop member 24 is shown here as viewed in the background. Also shown here is the support bar 20.

Figure 5:
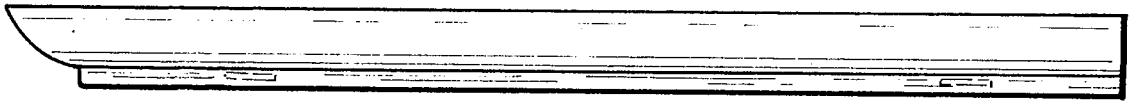
FIG. 5 is a side view thereof, the opposite side being a mirror image thereof.
Figure 4:
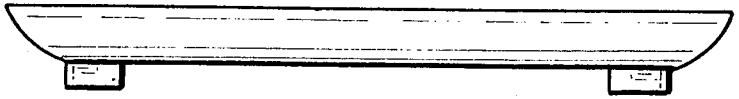
FIG. 4 is the opposite end view thereof.
Figure 6:
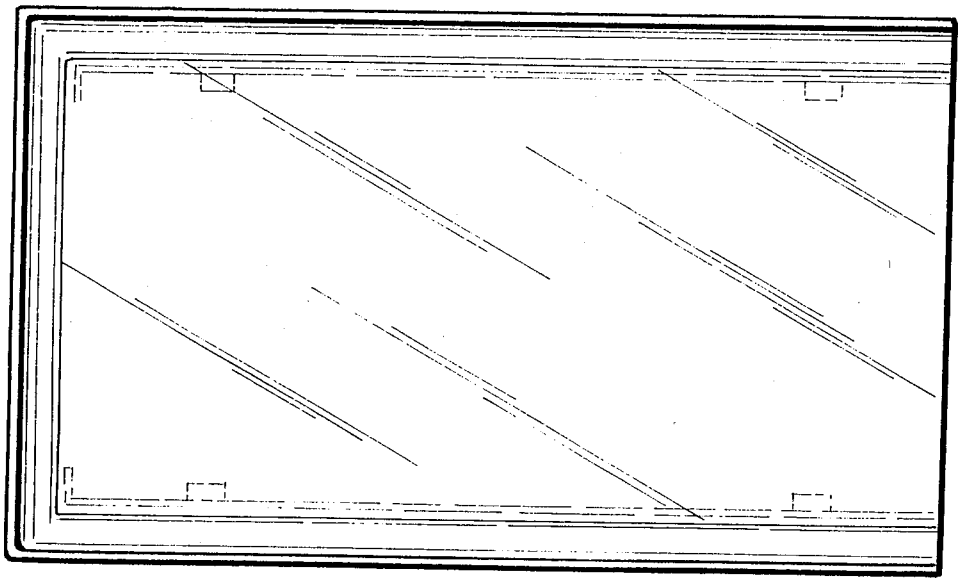
FIG. 6 is a top view thereof.

FIG. 4 through FIG. 6 are additional drawings which depict the preferred embodiments of the figures. FIG. 4 is the opposite end view of FIG. 3. FIG. 5 is a side view thereof, the opposite side being a mirror image thereof. FIG. 6 is a top view thereof.

While the above description contains many specificities, these should not be construed as limitations on the scope of the invention, but rather an exemplification of one preferred embodiment thereof. Many other variations are possible, for example, the support bars need not be restricted to extending only length-wise, but instead can also be situated at the front and rear ends of the tip tray bottom and extend width-wise. Other variations may be in the size, shape, and dimensions of the tip tray, which also need not be restricted. Still another variation to consider is that of color selection of the tip tray. While a transparent quality is ideal, varying tints of transparencies or combinations of semi-transparencies and solid colors may also be considered.

Accordingly, the scope of the invention should be determined not by the embodiment illustrated, but by the appended claims and their legal equivalents.

What is claimed is:

1. A tip tray comprising:

a rectangular, planar, transparent plate having a top and bottom surface, first and second lateral end edges, and first and second longitudinal side edges;

narrow upturned walls formed on the top surface of said plate and along only three edges thereof;

a pair of narrow, elongated, substantially parallel support bars formed on the bottom surface of said plate and along the first and second longitudinal side edges thereof, each of said support bar extending along at least a portion of the first lateral end edge of said plate to form a stop member;

at least two tabs formed along the sides of each of said support bars, said tabs extending laterally inward from said support bars, the top surface of said tabs being spaced from the bottom surface of said transparent plate to form a thin holding track between said bottom surface and said tabs for removably securing cardstock visible through said transparent plate.

2. The tip tray claimed in claim 1 wherein said stop member formed by the position of each of said pair of support bars along the first lateral edge in the bottom of said transparent plate prevent the removal of said cardstock from the first end of said tip tray.

3. The tip tray claimed in claim 2 wherein said narrow upturned wall on the top surface of said transparent plate is positioned along said first and second longitudinal edges and along said first lateral edge.

4. The tip tray claimed in claim 3 wherein said narrow upturned wall and each of said support bars are transparent.

5. The tip tray claimed in claim 3 wherein said transparent plate, said upturned wall, and said support bars are molded from a transparent plastic.

* * * * *